US009624841B2

(12) United States Patent
Scinicariello et al.

(10) Patent No.: US 9,624,841 B2
(45) Date of Patent: Apr. 18, 2017

(54) DEVICE FOR CONTROLLING THE SPEED OF AN INTERNAL COMBUSTION ENGINE

(71) Applicant: LOMBARDINI S.R.L., Reggio Emilia (IT)

(72) Inventors: Nicola Scinicariello, Reggio Emilia (IT); Valentino Scarpellini, Reggio Emilia (IT)

(73) Assignee: LOMBARDINI S.R.L. (IT)

( * ) Notice: Subject to any disclaimer, the term of this patent is extended or adjusted under 35 U.S.C. 154(b) by 318 days.

(21) Appl. No.: 14/334,524

(22) Filed: Jul. 17, 2014

(65) Prior Publication Data

US 2015/0027267 A1 Jan. 29, 2015

(30) Foreign Application Priority Data

Jul. 24, 2013 (IT) ..... RE2013A0053

(51) Int. Cl.

| | |
|---|---|
| ***G05G 1/04*** | (2006.01) |
| ***F02D 11/04*** | (2006.01) |
| ***F02D 1/04*** | (2006.01) |
| *F02D 1/00* | (2006.01) |

(52) U.S. Cl.

CPC ..... *F02D 11/04* (2013.01); *F02D 1/04* (2013.01); *F02D 1/045* (2013.01); *G05G 1/04* (2013.01); *F02D 2001/004* (2013.01); *F02D 2001/007* (2013.01); *F02D 2001/0045* (2013.01); *Y10T 74/2063* (2015.01)

(58) Field of Classification Search

CPC G05G 5/04; G05G 5/06; G05G 5/065; G05G 5/02; G05G 2700/08; G05G 1/04; B60K 20/008; F16H 59/04; F02D 11/04

See application file for complete search history.

(56) References Cited

U.S. PATENT DOCUMENTS

| | | | | |
|---|---|---|---|---|
| 3,695,244 | A * | 10/1972 | Vauille | 123/381 |
| 4,109,547 | A * | 8/1978 | Jacobson | 74/526 |
| 4,580,538 | A * | 4/1986 | Eheim | 123/364 |
| 4,802,451 | A * | 2/1989 | Takahashi | 123/373 |
| 4,949,591 | A | 8/1990 | Roelle | |

(Continued)

FOREIGN PATENT DOCUMENTS

| | | |
|---|---|---|
| JP | H09324660 | 12/1997 |
| WO | 2012147237 | 11/2012 |

OTHER PUBLICATIONS

Italian Search Report for IT RE2013A000053 dated Apr. 11, 2014.

*Primary Examiner* — Vicky Johnson

(74) *Attorney, Agent, or Firm* — The Belles Group, P.C.

(57) ABSTRACT

A device for controlling the speed of an internal combustion engine comprising a control lever movably associated to a support element, which may be the engine casing or a portion thereof. The control lever is moveable at least between a first position, in which the engine is at a first rotation regime, and a second position, in which the engine is at a second rotation time. A selective locking mechanism is provided that prohibits the control lever from being stably positioned at any (and all) intermediate positions between the first and second positions. In one embodiment, a biasing force generated by the device automatically forces the control lever into one of the first or second positions when the control lever is located in any of the intermediate positions and an actuation force is ceased.

28 Claims, 10 Drawing Sheets

(56) References Cited

U.S. PATENT DOCUMENTS

| | | | |
|---|---|---|---|
| 6,520,489 | B1 | 2/2003 | Morris |
| 7,195,527 | B2 | 3/2007 | Tani et al. |
| 7,201,144 | B2 | 4/2007 | Yuasa |
| RE40,350 | E | 6/2008 | Kotchi et al. |
| 7,503,232 | B2 | 3/2009 | Ono et al. |
| 2003/0071371 | A1 | 4/2003 | Morris |

* cited by examiner

DEVICE FOR CONTROLLING THE SPEED OF AN INTERNAL COMBUSTION ENGINE

CROSS REFERENCE TO RELATED APPLICATIONS

This application claims priority under 35 U.S.C. §119 to Italian Patent Application No. IT RE2013A000053, filed Jul. 24, 2013, the entirety of which is hereby incorporated by reference.

TECHNICAL FIELD

The present invention regards a device for controlling the speed of an internal combustion engine.

More in particular, the invention regards a control device arranged in proximity of the controlled member, such as for example a fuel injection pump, of an internal combustion engine, for example a diesel engine.

BACKGROUND OF THE INVENTION

As known, internal combustion engines can be divided into two main categories: the first category comprises the internal combustion engines provided with speed regulator, which is adapted to maintain the speed of rotation of the engine constant upon the variation of the load applied to the engine, and the second category comprises engines without speed regulator, regarding which the rotation speed varies as a function of the applied load.

The engines provided with regulator generally have a lever which is rotatably associated to the engine casing and it is arranged in the proximity of the controlled member which is designated to continuously regulate the speed, in particular in diesel engines such controlled member could be the injection pump, in engines provided with carburettor it could be the throttle of the carburettor or another member, whose actuation leads to a variation of the amount of fuel supplied to the combustion chamber.

Such lever is free to rotate, for a limited angle, with continuity, thus continuously varying, for example, the speed of the engine.

The lever arranged in proximity of the controlled member is, then, in turn controlled by a remote lever, arranged in a position accessible by a user, through return means, such as bowden cables, rigid rods or any other return means of the known type.

In order to transform an engine provided with such lever for controlling the continuous regulation of the speed in a preferential two-speed engine, there are known remote levers (i.e. accessible to the user) which have two or more stop positions angularly separated and spaced from each other.

A known remote lever of this type is described in the U.S. Pat. No. 4,949,591.

Such lever of the known type has a discrete angular stroke so as to be able to transfer the rotation to the lever arranged in proximity of the controlled member and thus, the stop positions, for example at the position of minimum speed of the engine and maximum speed of the engine, are necessarily angularly spaced from each other.

However, a drawback revealed in these remote levers lies in the fact that they however allow the positioning of the lever in intermediate positions interposed between the minimum and maximum speed positions, practically maintaining the engine at a continuously adjustable speed.

An object of the present invention is to overcome the aforementioned drawbacks of the prior art, through a simple, rational and inexpensive solution.

In practice, an object of the present invention is to efficiently transform a continuously adjustable speed engine into an engine with imposed two speeds, substantially preventing the possibility of adjusting the speed in the intermediate positions to the minimum and maximum speed or optimal speed position.

SUMMARY OF THE INVENTION

A device for controlling rotational speed of an internal combustion engine is provided. In one aspect according to the invention, the device ma comprise a control lever movably coupled to a support element, a detent element associated with one of the control lever or the support element, and first and second seats associated with the other one of the control lever or the support element. The control lever is actuatable between: (1) a first position in which the detent element engages the first seat and the internal combustion engine operates at a first rotational speed: and (2) a second position in which the detent element engages the second seat and the internal combustion engine operates at a second rotational speed. When the control lever is at any (and all) intermediate positions between the first and second positions, a biasing force forces the detent element into engagement with either the first seat or the second seat to cause the control lever to automatically assume either the first or second positions respectively.

The first rotational speed may correspond to a minimum engine speed and the second rotational speed may correspond to a maximum engine speed. A biasing member may be provided as part of the device that generates the biasing force.

According to an arrangement the biasing member is an elastic member which may impart the biasing force on the detent element. In other arrangements, the elastic member could impart the biasing force, either directly or indirectly, on a structure in which the first and second seats are formed and or associated. In other arrangements, the biasing force can result from one or more elements of the device being constructed (and/or arranged) so that the requisite biasing force is internally generated. For example, the control lever could be mounted to the support element so that the control lever is naturally biased toward the support element (or other components) to generate the biasing force. This could be achieved by selecting proper materials of construction of the lever and proper relative positioning thereof.

In other arrangements the biasing member may be a magnetic member generating the biasing force.

The first and second seats may be separated from one another by a wall. At least one of the wall or the detent element may comprise a convex surface that is forced into surface contact with a surface of the other one of the wall or the detent element by the biasing force. As a result of this interaction (and the confirmed exertion of the biasing force), the control lever will automatically assume either one of the first or second positions when the control lever is at any (and all) intermediate positions between the first and second positions. The wall, if desired, may comprise a narrowed waist section that is located along an imaginary circumference on which centres of the first and second seats are also located. If desired, each of the first and second seats may comprise a chamfered edge to help facilitate the interaction described above.

The detent element may, in certain instances, comprise a sphere, which may be disposed in a cylindrical seat. The detent element may, in certain specific arrangements, also comprise a deadbolt associated with one of the support element or the control lever. The cylindrical seat may be provided in the deadbolt. If the elastic member and the cylindrical seat are included, the elastic member may be positioned within the cylindrical seat beneath the sphere.

Depending on the needs and structural arrangement of the specific internal combustion engine being controlled, the control lever may be movably coupled to the support element so that the resulting relative movement between the control lever and the support element may be rotational, translational, or combinations thereof.

If the control lever is pivotably coupled to the support element, the control lever may be pivotable about a rotation axis. As a result, the first position will be a first angular position and the second position will be a second angular position. Thus, when the control lever is at any intermediate angular position between the first and second angular positions, the biasing force forces the detent element into engagement with either the first seat or the second detent element to cause the control lever to automatically assume either the first or second angular position respectively. When rotational coupling is utilized, the biasing force may be generate such that is has a direction that is substantially parallel to the rotation axis. Additionally, in certain instances of rotational coupling, the centres of the first and second seats may be separated by a preset angle along an imaginary circumference formed about the rotation axis.

The device may further comprise a plate fixed to the control lever. The plate may comprise either the detent element or the first and second seats. Utilization of such a plate may allow existing engine designs to be modified to include the present invention with little modification to the existing design.

In another aspect, the invention may be an internal combustion engine comprising a casing and a device as described in any of the preceding paragraphs.

In yet another aspect, the invention may be a method of controlling rotational speed of an internal combustion engine. The method may comprise: a) applying an actuation force to a control lever to move the control lever, relative to a support element, into an intermediate position between a first position in which the internal combustion engine operates at a first rotational speed and a second position in which the internal combustion engine operates at a second rotational speed; and b) upon cessation of the actuation force, the control lever automatically assuming either the first position or the second position in response to a biasing force. The method may include any of structural and/or functional concepts described above in the preceding paragraphs In a further aspect, the invention provides a device for controlling the speed of an internal combustion engine comprising as control lever rotatably associated to a support element fixable to the engine casing and moveable at least between a first position, in which the engine is substantially at a first rotation regime, for example the minimum rotation regime, and a second position, in which the engine is substantially at a second rotation regime, for example the maximum rotation regime or an optimal selectable rotation regime greater than the minimum regime, holding means of said lever being configured to removably selectively lock the lever in said first and said second position.

According to the invention, the holding means comprise at least one deadbolt associated to at least one from among said support element and said control lever and configured to be selectively engaged at: least in a first seat and a second seat associated to the other from among the control lever and the support element, the first seat and the second seat being substantially contiguous.

Such solution allows transforming a continuously adjustable speed engine into an engine with at least two imposed speeds, practically hindering the possibility of adjusting the speed of the engine in an intermediate area between the two imposed speeds of the engine, in an advantageous, inexpensive and quick manner.

In addition, an aspect of the invention provides for that the deadbolt be slidably associated, with respect to a direction substantially parallel to the rotation axis of the lever, at least one from among said support element and said control lever and be moveable from an extracted position to a retracted position, countering elastic means, adapted to provide an automatic coupling between said deadbolt in extracted position and, selectively, one from among the first seat and the second seat, following a mutual rotation of the control lever by a preset rotation angle.

Thus, the removable locking of the control lever in the positions of minimum and maximum/optimal speed of the engine may be carried out in an easy, quick and safe manner.

In addition, a further aspect of the invention provides for that the preset rotation angle of the control lever is comprised between 14° and 25°, preferably 20°.

Such angle allows adapting the device to any engine, in particular to any diesel engine, in which the maximum/optimal rotational speed is about 3600 rpm and the minimum rotational speed of 1000 rpm, compensating the variations present between one engine and the other.

Advantageously, the deadbolt comprises a sphere slidably inserted in a cylindrical seat; a compression spring is interposed between the bottom of the cylindrical seat and said sphere to push the sphere in the extracted position.

This configuration of the deadbolt allot ensuring that this always occurs within one from among the first and the second seat, without the possibility of stopping in an intermediate position there between.

Furthermore, the first seat and the second seat are aligned to each other along an imaginary circumference, thus they can be selectively interposed to the cylindrical seat in which the deadbolt is housed, following a mutual rotation between control lever and the support element.

Advantageously, said first seat and said second seat are substantially with circular section and they are spaced from each other by a distance lesser than the diameter of one from among the first and the second seat.

In practice, the distance between the centres is substantially comprised between 1 and 1.3 times (preferably approximately equal to 1.1 times) the sums of the radii of the first and of the second seat.

This allows ensuring that the deadbolt also falls, pushed by the elastic means, within one from among the first and the second seat.

Furthermore, the control lever is adapted to be selectively positioned in a third position, in which the engine is off.

Advantageously, the first seat and the second seat are made of a plate fixed to said control lever and said deadbolt is associated to said support element, so as to project at least partly outside therefrom when it is in extracted position.

In the plate, besides the seats, it is possible to define a pad, aligned with the first and the second seat, in which the deadbolt can be housed and it is adapted to allow the third position to the control lever.

A third aspect of the invention allows an internal combustion engine comprising a casing and a device for controlling the speed of the engine, like described above, in which the support element is fixed to said casing.

BRIEF DESCRIPTION OF THE DRAWINGS

Further characteristics and advantages of the invention shall be apparent from reading the following description provided by way of non-limiting example, with reference to the figures illustrated in the attached drawings.

DETAILED DESCRIPTION OF THE INVENTION

Figure 1:
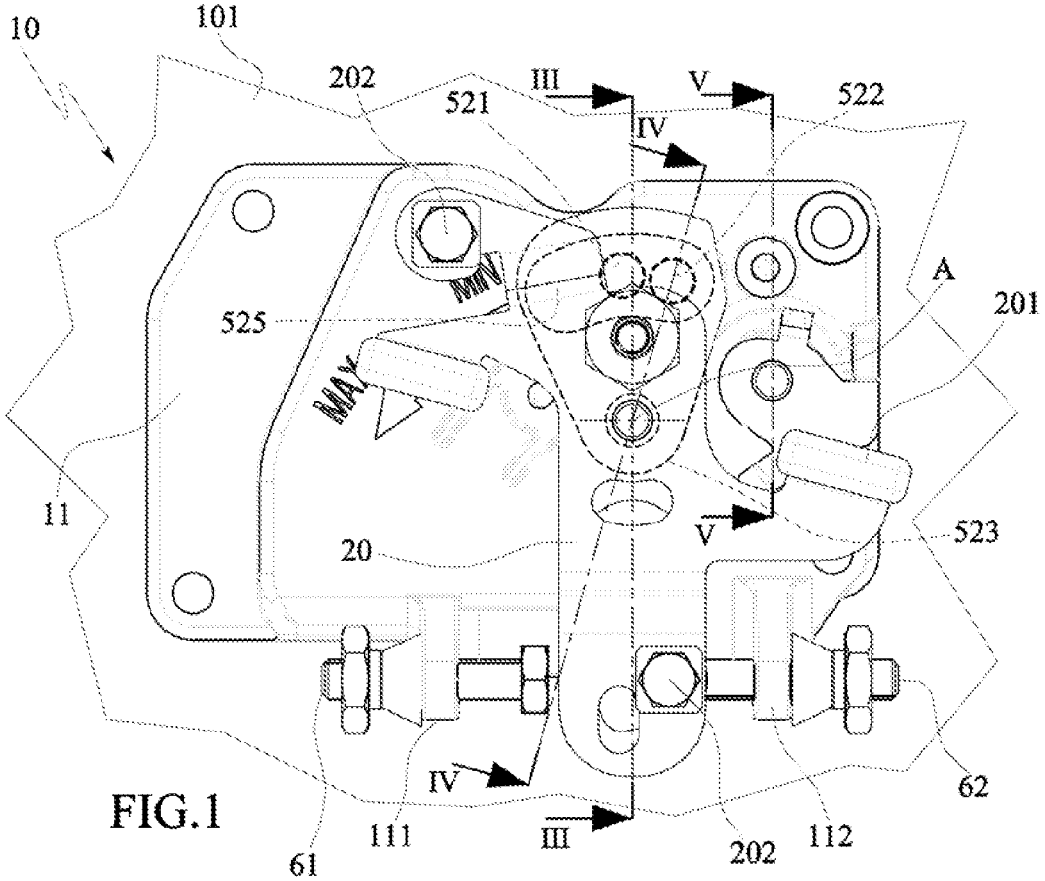
FIG. 1 is a front view of the device from outside the engine casing according to the invention.
Figure 2:
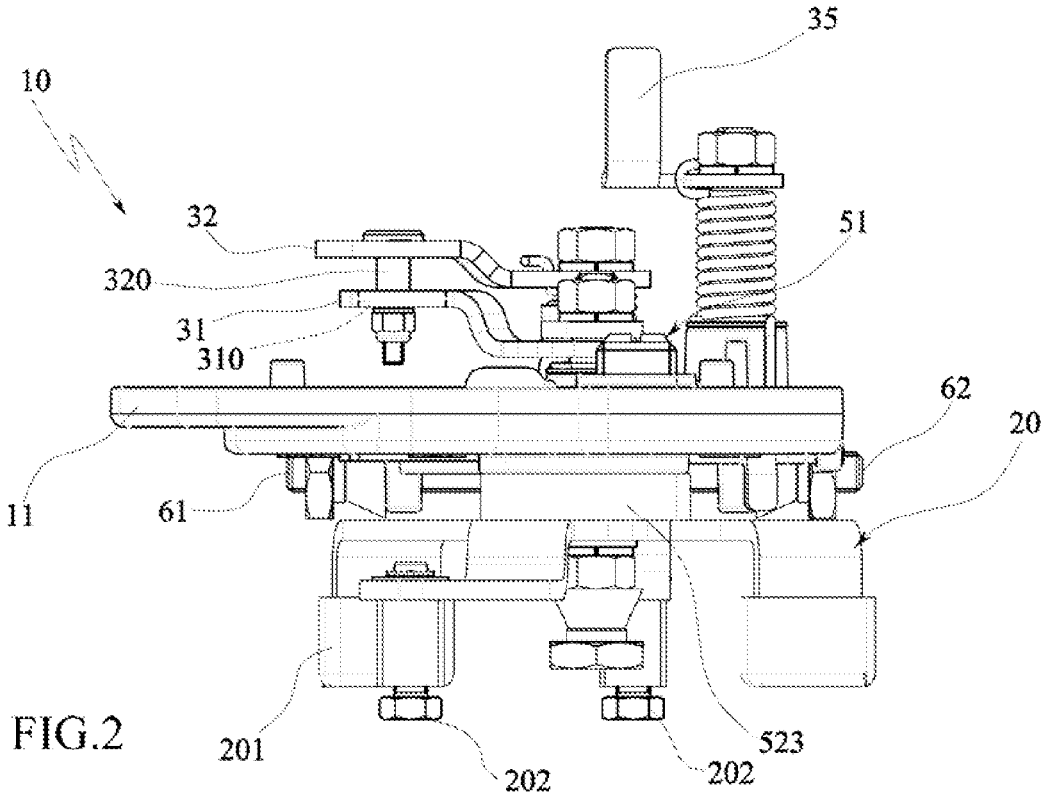
FIG. 2 is a top view of FIG. 1.
Figure 3:
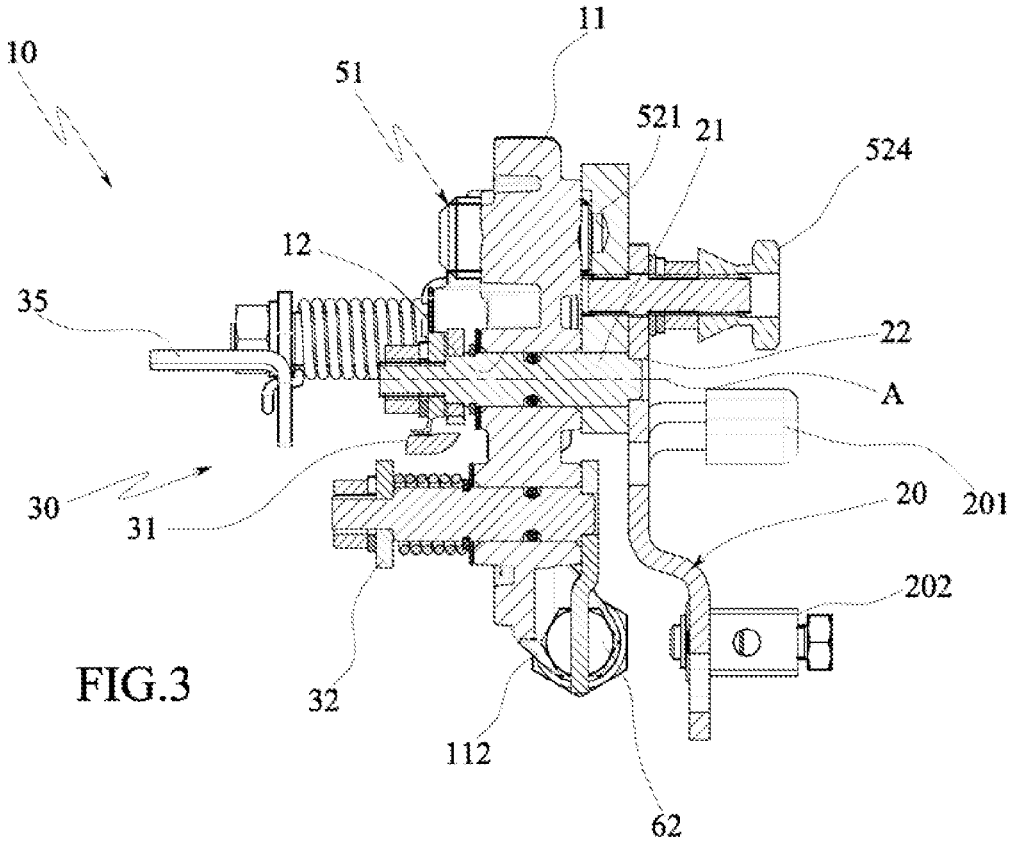
FIG. 3 is the view along the line of section III-III of FIG. 1.
Figure 4:
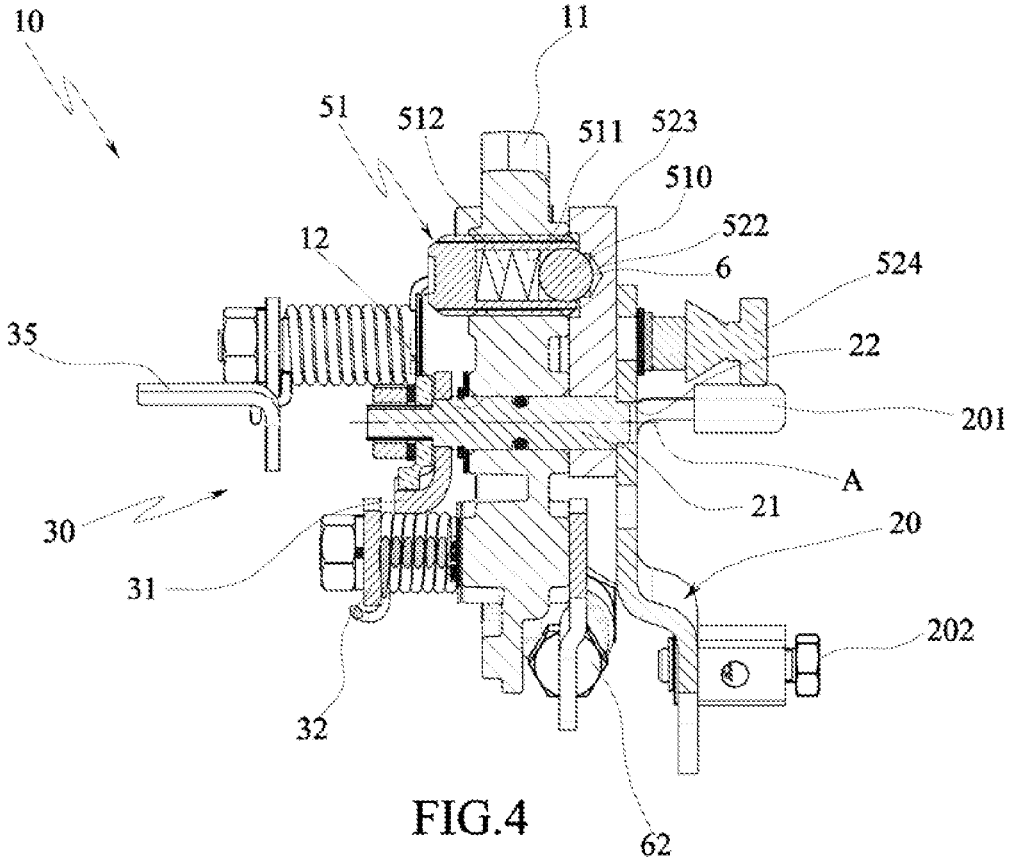
FIG. 4 is the view along the line of section IV-IV of FIG. 1.
Figure 5:
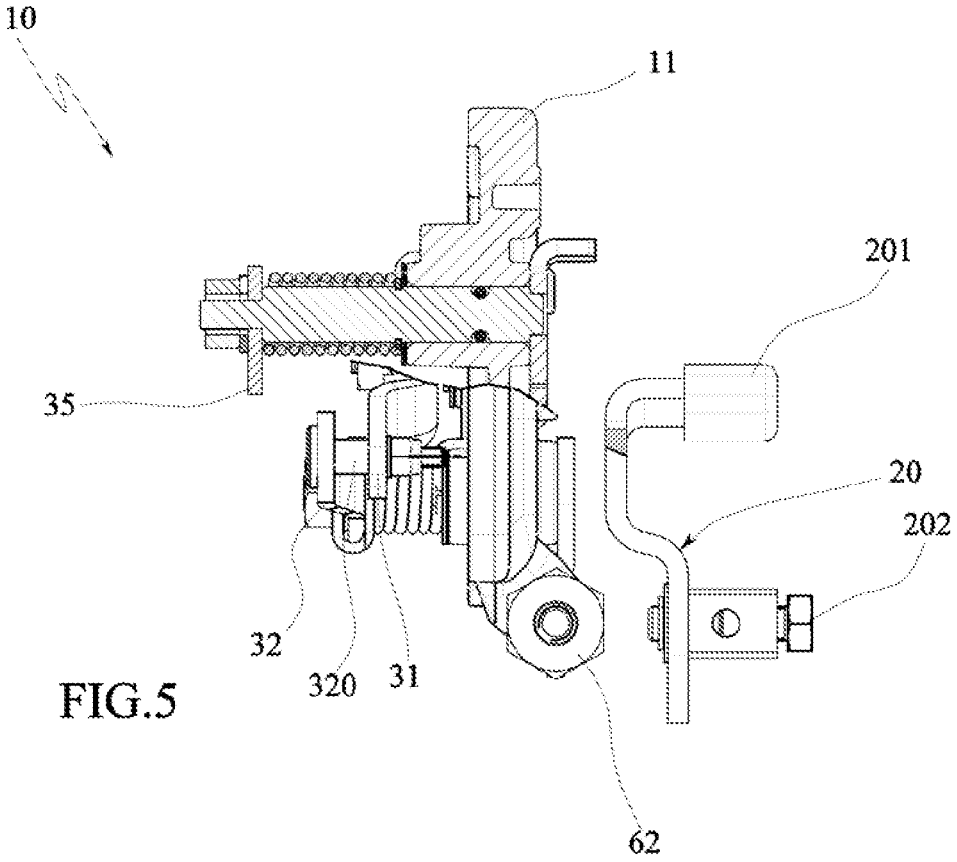
FIG. 5 is the view along the line of section V-V of FIG. 1.
Figure 6:
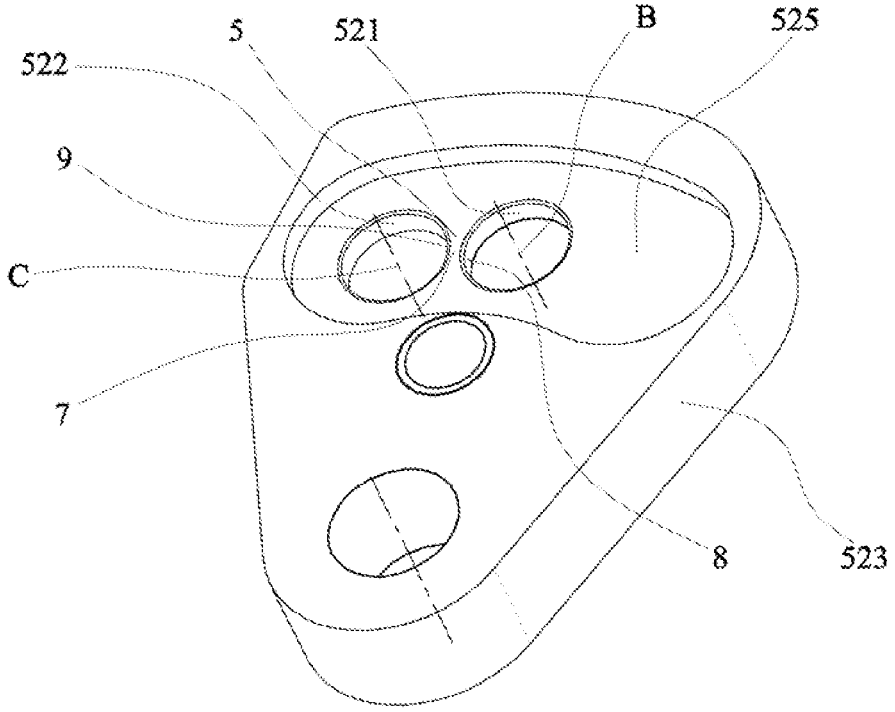
FIG. 6 is an axonometric view of the plate containing the adjacent seats of the holding means according to the invention.
Figure 7:
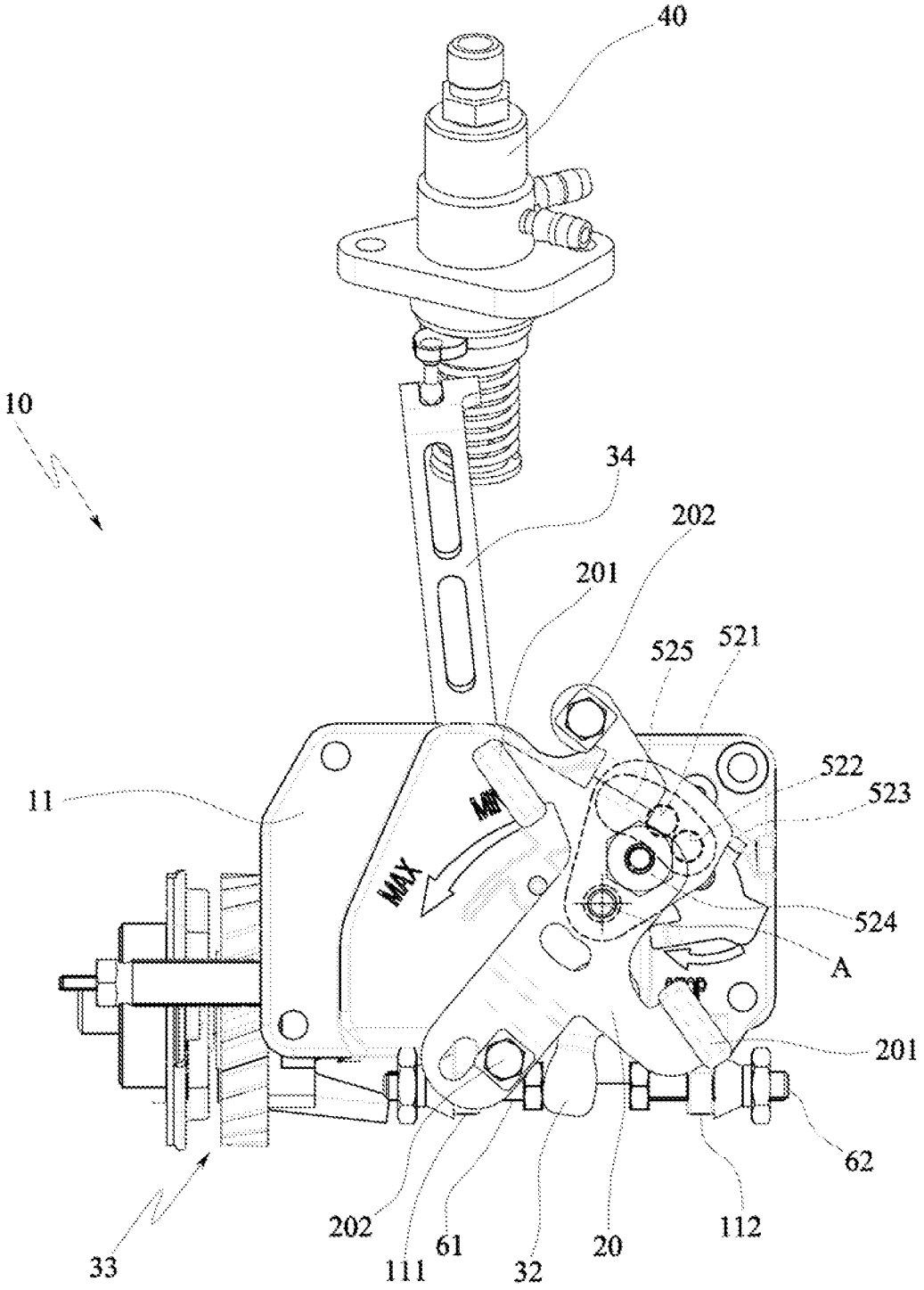
FIG. 7 and FIG. 8 are, respectively, an external and internal front view of the device, according to the invention, with the control lever in the engine top position.
Figure 8:
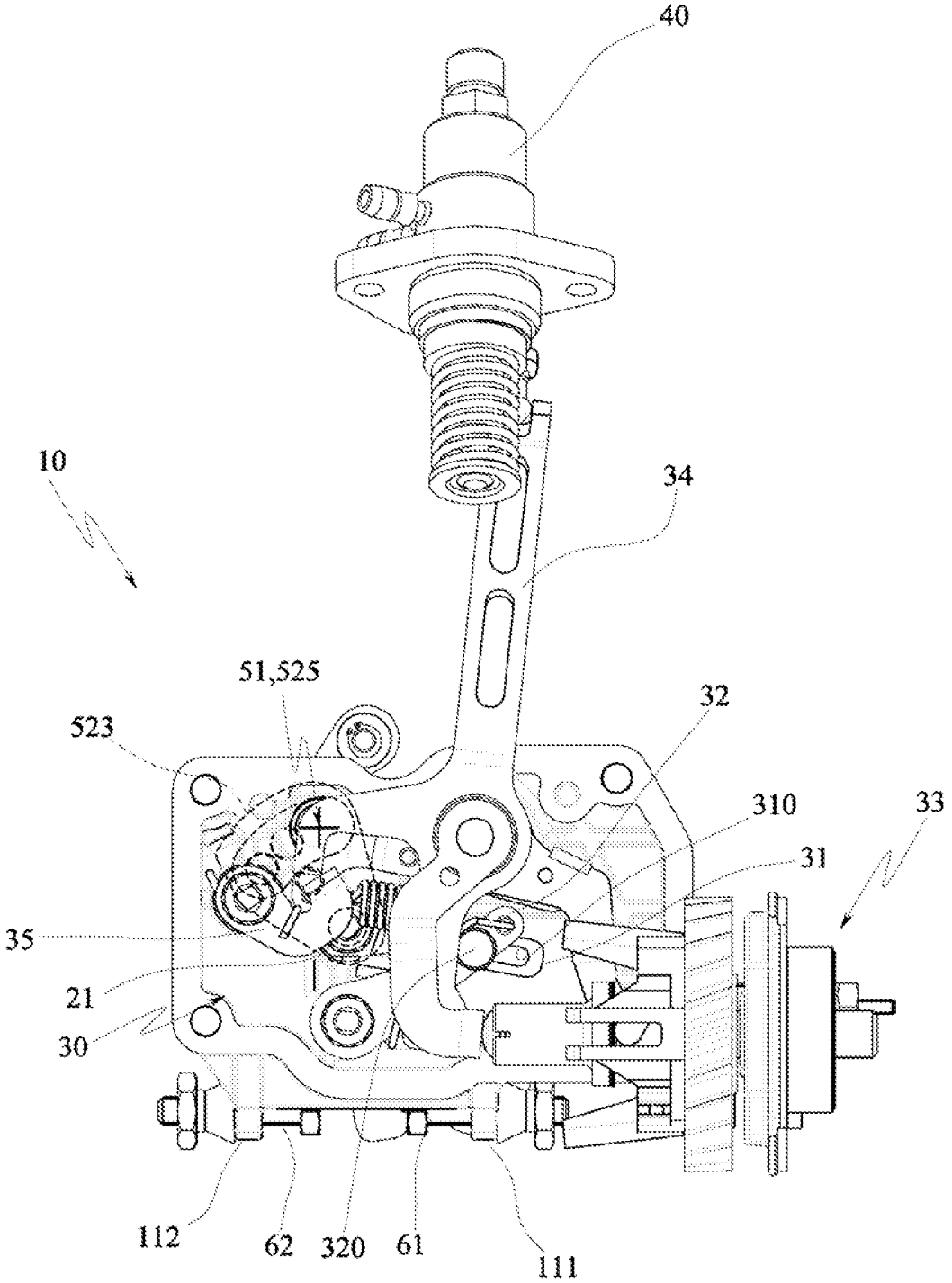
Figure 9:
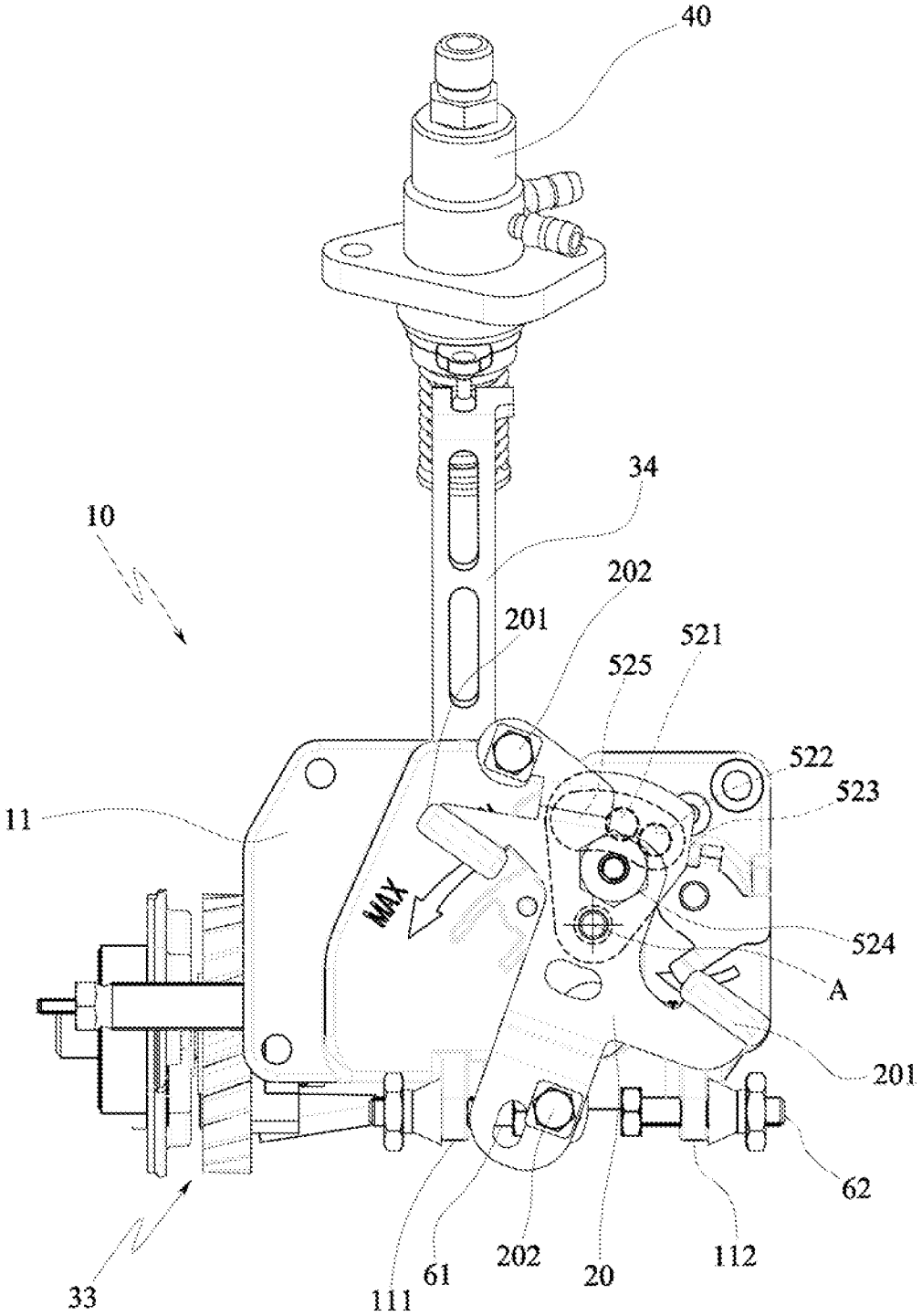
FIG. 9 and FIG. 10 are, respectively, an external and internal front view of the device, according to the invention, with the control lever in position of minimum rotational speed of the engine.
Figure 10:
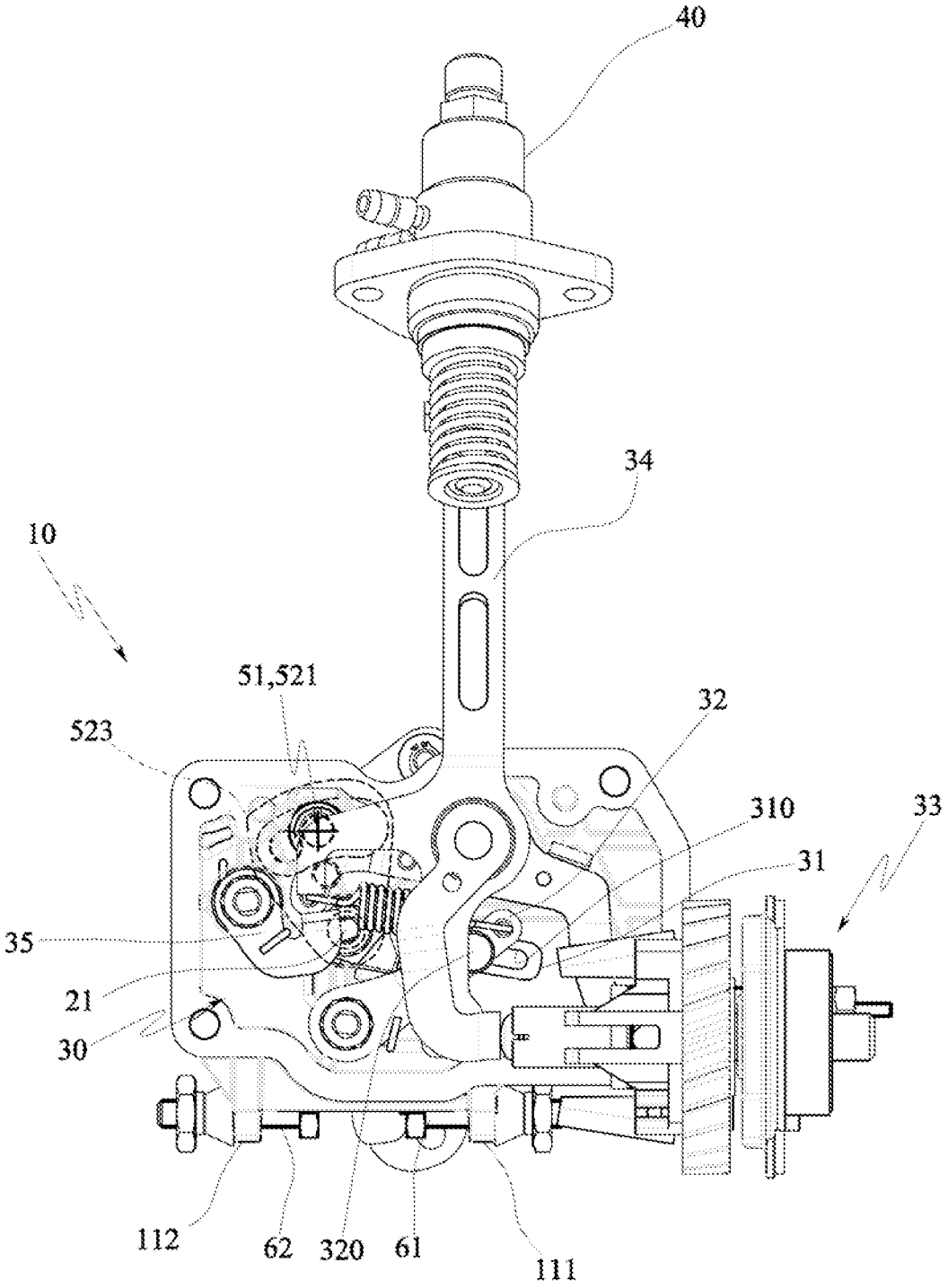
Figure 11:
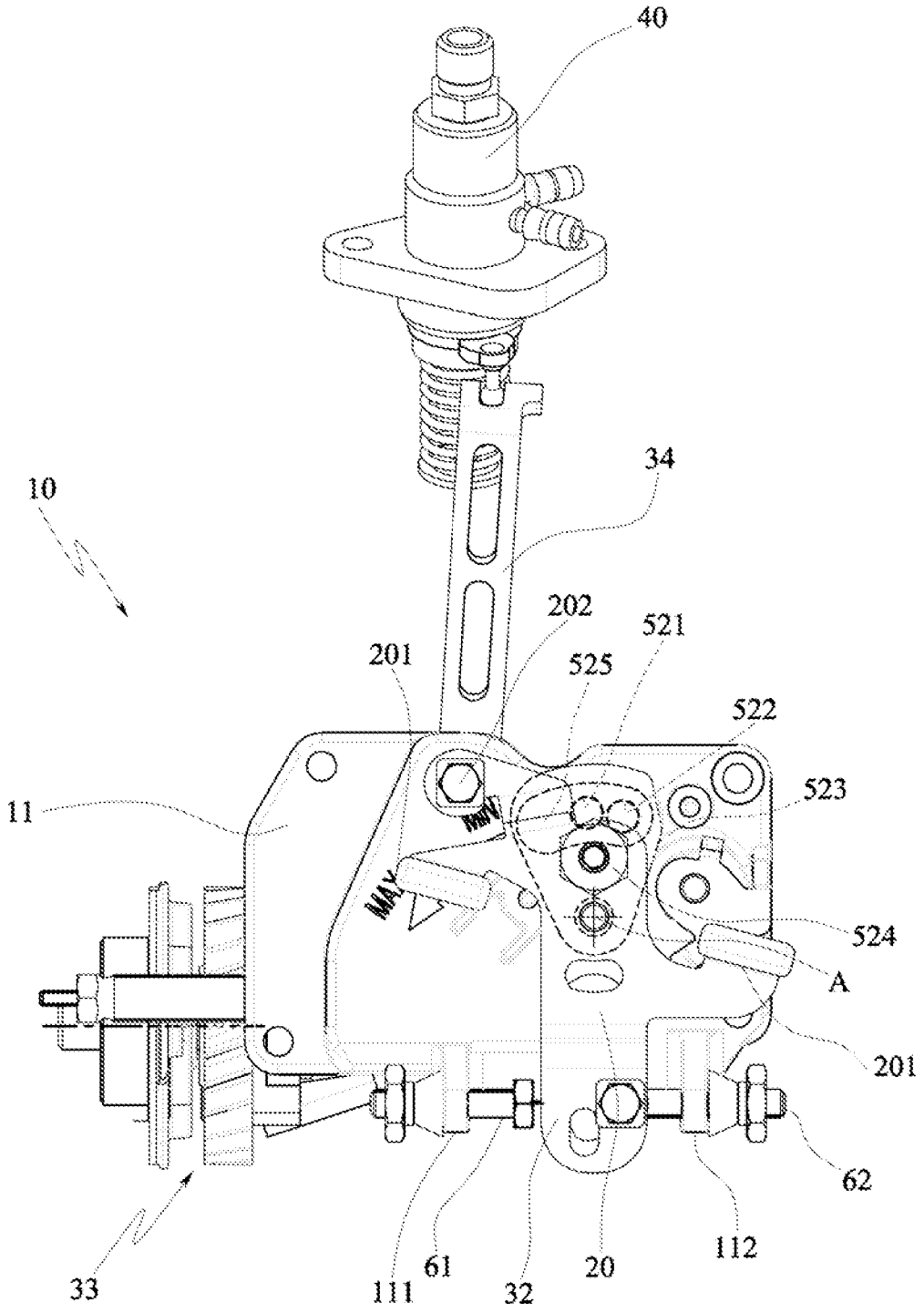
FIG. 11 and FIG. 12 are, respectively, an external and internal front of the device, according to the invention, with the control lever in position of maximum/optimal rotational speed of the engine.
Figure 12:
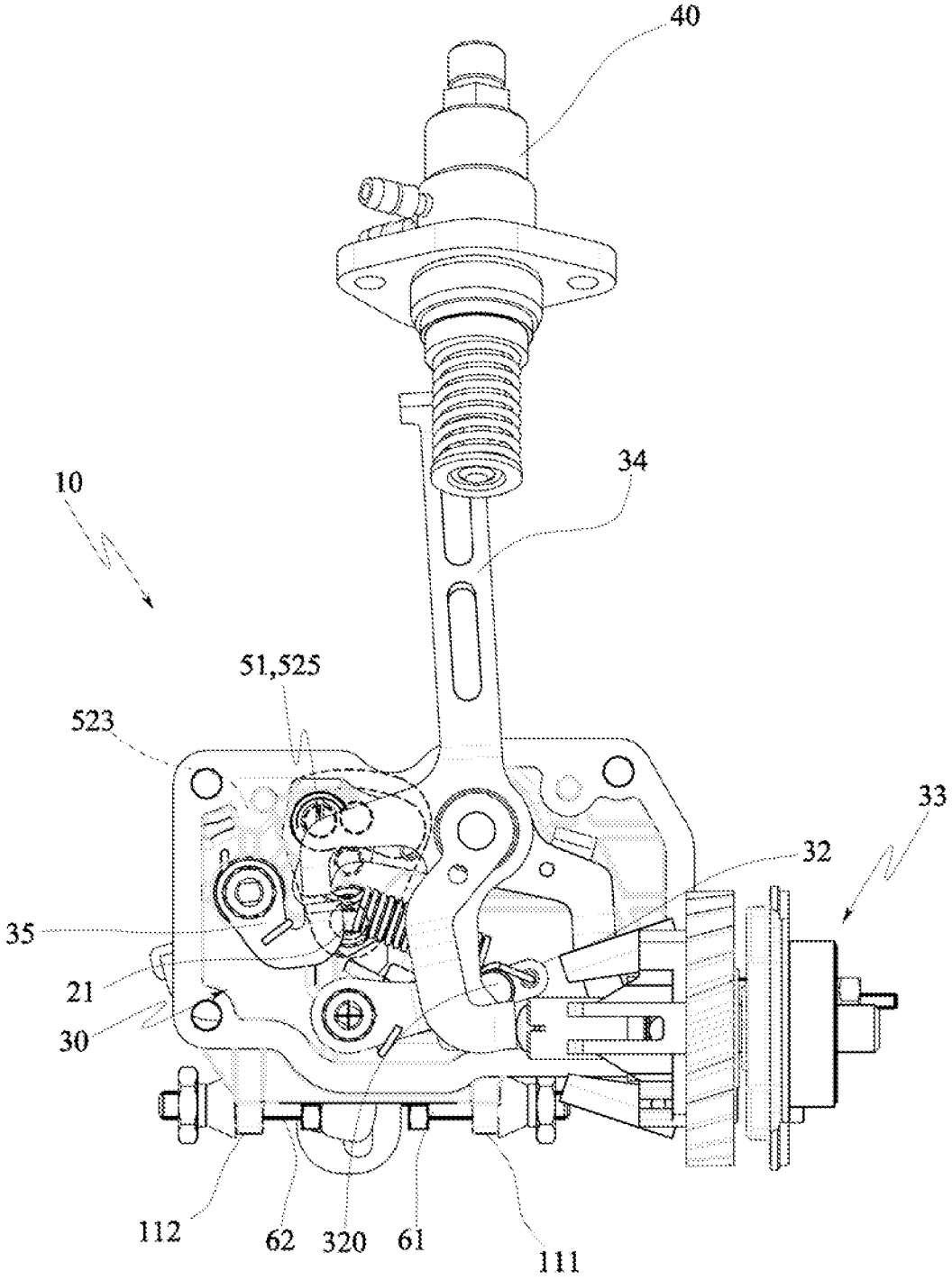

The features and benefits of the present disclosure are illustrated and described herein by reference to exemplary embodiments. This description of exemplary embodiments is intended to be read in connection with the accompanying drawings, which are to be considered part of the entire written description. Accordingly, the present disclosure expressly should not be limited to such embodiments illustrating some possible non-limiting combination of features that may exist alone or in other combinations of features; the scope of the claimed invention being defined by the claims appended hereto.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described urns shown in the drawing under discussion. These relative terms are for convenience of description only and do not require that the apparatus be constructed or operated in a particular orientation. Terms such as "attached," "coupled," "affixed," "connected." "interconnected," "associated" and the like refer to as relationship wherein structures are secured or attached to one another either directly or indirectly through intervening structures, unless expressly described otherwise.

Figure 13:
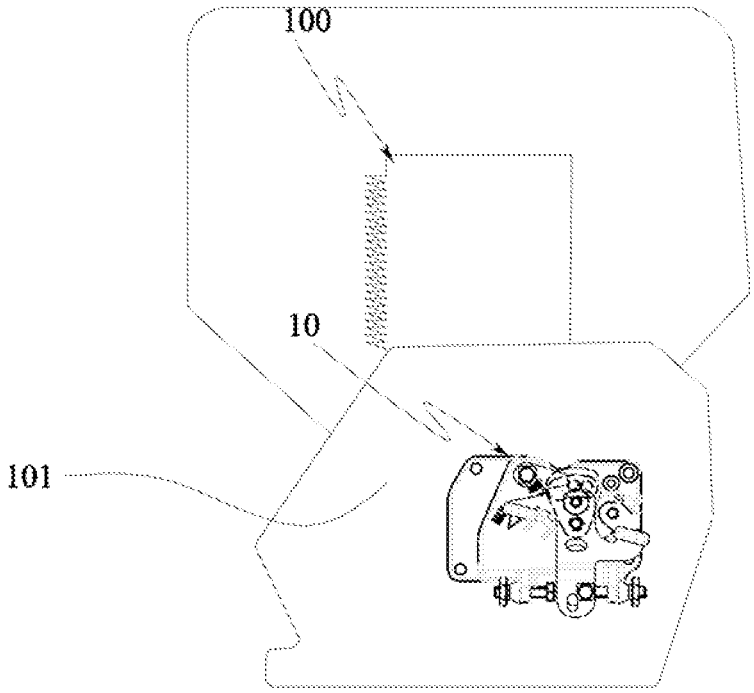
FIG. 13 is a front schematic view of the device from outside the casing of an internal combustion engine according to the invention.

With particular reference to such figures, a speed control device 10 of an internal combustion engine 100 (as shown in FIG. 13) for example a diesel engine, provided with an external casing 101.

The device 10 comprises a support element 11 (for example a lid) which can be fixed, by means of screws, to the engine casing so as to be actually (removable) part thereof. While exemplified as a lid of the engine casing, as used herein the term "support element 11" can take on a wide variety of structures. In one arrangement, the support element 11 may be a non-removable portion of the engine casing or another component affixed thereto. In other arrangements, the support element 11 can be another engine component or a portion of the frame that supports the internal combustion engine.

Furthermore, the device 10 comprises a control lever 20, which is moveably coupled to the support element 11. In the illustrated arrangement, the control lever 20 is rotatably associated, with respect to a rotation axis A, to the support element 11 by means of a rotation pin 21. In other arrangements, the control lever 20 may be movably coupled to the support element 11 so that the resulting relative movement between the control lever 20 and the support element 11 may be translational or combinations of rotational and translational. The exact type of movable mounting selected will depend on the specific needs and structural arrangement of the internal combustion engine being controlled. The structural nature and location of the support element 11 selected may also determine whether rotational and/or translational mounting is selected.

As illustrated, the rotation pin 21 is inserted into a through hole 12 obtained in the support element 11, so as to project from both sides.

The control lever 20 comprises a respective through hole 22 in which the projecting portion of the rotation pin 21 is inserted from the support element 11 side intended to be arranged outside the casing.

A linkage 30, to be described in detail hereinafter, connected to an injection pump 40, for injecting fuel into the engine cylinder/s, as known to a man skilled in the art, to vary the rotational speed of the engine, is associated to the portion projecting inside the casing of the rotation pin 21.

Thus, the control lever 20 oscillates around the rotation axis A, rotating the rotation pin 21, at least between a first position, corresponding to the position in which, through suitable positioning of the levers which constitute the linkage 30, the engine is substantially at the minimum rotation regime, and a second position, in which the engine is substantially at the maximum rotation regime (for example an optimal rotation regime greater than the minimum rotation regime of the engine).

Particularly for the purposes of the present invention, the device 10 comprises holding means of the control lever 20, Which are adapted to removably selectively lock the lever in the first and in the second position.

The illustrated holding means generally comprises a detent element associated with one of the control lever 20 or the support element 11, and first and second seats 521, 522 associated with the other one of the control lever 20 or the support element 11. As illustrated, the detent element is associated with the support element 11 and comprises a deadbolt 51 which is adapted to selectively engage at least a first seat 521 and a second seat 522, which as illustrated, are associated with the control lever 20. The first seat 521 and the second seat 522 are substantially contiguous to each other, so that the deadbolt 51 cannot stably occupy any transitory intermediate position interposed between the first seat and the second seat.

In practice, the expression "contiguous" is used to indicate two seats approached to each other, so that between one and the other there is defined a smaller interspace with respect to the width (in the direction of joining the seats) of the deadbolt 51. Thanks to this configuration the deadbolt 51 cannot be stably positioned in an intermediate position between the two seats 521,522, thus guaranteeing that the deadbolt 51 is always pushed into one of the seats 521, 522 upon each actuation of the control lever 20. As discussed below, the deadbolt 51 (and specifically the sphere 510) is subjected to a bias force generated by the elastic member 512 (which is exemplified in the form of a compression spring).

Alternatively, the biasing force is generated by a biasing member in the form of a magnetic element configured to force the deadbolt 51 to engage one of the seats 521,522 and forcing, therefore, the control lever 20 into one of the first or second position, when the control lever 20 is located in any of the intermediated positions (forbidden) and an actuation force is ceased.

Figure 14:
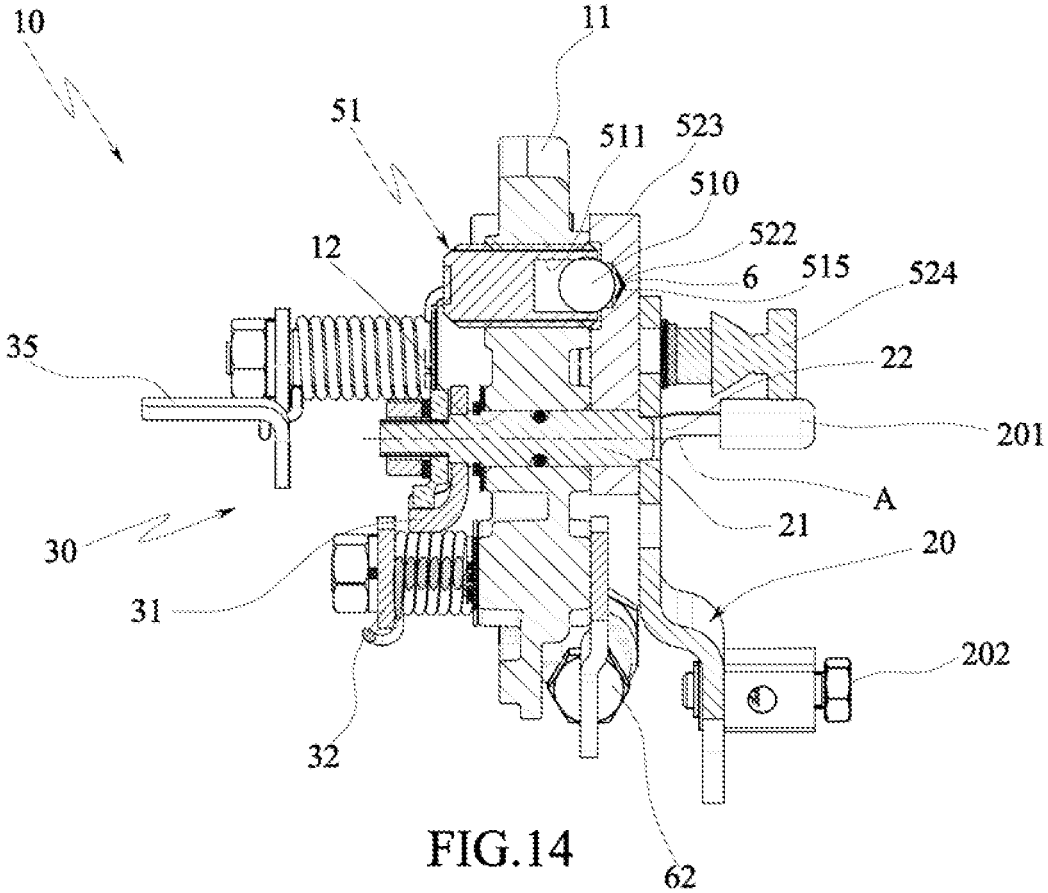
FIG. 14 is the view along the line of section IV-IV of FIG. 1 showing another arrangement of the biasing member.

The magnetic element as shown in FIG. 14) may comprise a magnet 515 inserted into each of the seats 521,522 such as to attract the deadbolt 51, the latter being for example made of a metal attractable by magnets, i.e. iron or the like.

Therefore the biasing three can be a magnetic force or an electromagnetic force, but in other possible embodiments gravity or other biasing forces may be non-limiting examples of other useful types of biasing forces.

When the deadbolt 51 engages the first seat 521, the control lever 20 is stably held in the first position, when the deadbolt 51 instead engages the second seat 522, the control lever 20 is stably held in the second position.

The deadbolt 51 is slidably associated, with respect to a direction substantially parallel to the rotation axis A of the control lever 20, to the support element 11 and it is moveable between an extracted position, in which it projects at least partly outside the support element 11 from the part in which the control lever is present, and a retracted position, in which it is substantially contained in the supper element 11.

The deadbolt 51 comprises at least one sphere 510 slidably inserted hi a cylindrical seat 511 fixed into a (through) hole obtained in the support element in an eccentric position with respect to the rotation axis A of the control lever with respect to the support element.

The cylindrical seat 511 is obtained within a cup body, for example threaded externally so as to be fastened into the hole provided for in the support element 11, whose open top part (facing towards the external of the casing) has an annular narrowing adapted to hold the sphere 510 at least partially within the cylindrical seat 511 in its extracted position too. In other arrangements, the cylindrical seat 511 in which the sphere 510 is held may be formed directly into a portion of the support element 11, such as the engine casing Or the casing lid, or another component associated with the engine casing. In still other arrangements the cylindrical seat 511 in which the sphere 510 is held may be formed directly into a portion of the control lever 20 or another component associated with the control lever 20.

Within the bottom of the cup body and the sphere 511 there are interposed elastic member, for example a compression spring, such as a helical spring 512, which is adapted to push the sphere in the extracted position. While the elastic member 512 is exemplified as a helical spring in the illustrated embodiment, the elastic member 512 can take on other forms. For example, the elastic member 512 may take the form of a mass of resilient material, such as rubber, spring steel, thermoplastic elastomers, or the like, and may be located at different positions in the device 10.

In practice, the deadbolt 51 under the action of the helical spring 512 is adapted to provide an automatic snap coupling, selectively, with one from among the first seat 521 and the second seat 522, following a mutual rotation of the control lever 20 by a preset rotation angle, equal to the angular distance between the centres B, C of the first and the second seat. Thought of another way, the elastic member 512 generates a continuous biasing force on the deadbolt 51 (specifically on the sphere 511 thereof) that forces a convex surface 7 of the sphere 511 into surface contact with a narrowed waist section 7 of a wall 5 that separates the first and second seats 521, 522. Thus, when the control lever is positioned in any transitory intermediate position between the first and second positions (and the actuation force is ceased), the biasing force exerted by the elastic member 512 forces the convex surface 6 of the sphere 511 into surface contact with the upper surface of the narrowed waist section 7 of the wall 5. Due in part to the convex nature of the sphere 511, the sphere's 511 ability to roll, and the narrowed width of the wall 5 at the point/path of contact, the bias force causes lateral relative movement between the convex surface 7 and the upper surface of the wall 5, thereby causing the control lever 20 to automatically assume either the first or second positions due to the sphere 511 being forced into either of the first or second seats 521, 522. Stated simply, the control lever 20 cannot stably be positioned at any intermediate position that is between the first and second positions (in which the sphere 511 engages the first and second seats 521, 522 respectively). The tendency of the control lever 20 to automatically assume the first and second positions when positioned at any intermediate transitory position is further enhanced by providing the first and second seats 521, 522 with chamfered edges 8, 9. It should also be noted that, as a result of the chamfering, the edges of the wall 5 are also chamfered.

While in the illustrated embodiment, the detent member (and specifically the sphere 511 thereof) comprises the convey surface 7, in other arrangements the upper surface of the wall 5 could be made adequately convex, instead of or in addition to the surface of the detent member that is biased into contact therewith.

Further, while the bias force is exemplified as being generated by the elastic member 512 and exerted on the detent element (specifically the sphere 511 thereof), in other arrangements the elastic member 512 could be positioned to exert the biasing force, either directly or indirectly, on a structure in which the first and second seats 521, 522 are formed and/or associated. In still other arrangements, a distinct elastic member 512 is not necessary and may be omitted, in such an arrangement, the biasing three can be inherent to one or more of the other components of the device 10. For example, the control lever 20 could be mounted to the support element 11 so that the control lever is naturally biased toward the support element 11 (or other components) to generate the biasing force. This could be achieved by selecting proper materials of construction of the control lever 20 and proper relative positioning thereof.

The first seat 521 and the second seat 522 are aligned to each other along, an imaginary circumference, for example centred on the rotation axis A of the control lever 20 with respect to the support element 11, whose centres B, C are at a distance from the rotation axis A substantially equal to the distance of the axis of the cylindrical seat 511 from the rotation axis A.

Particularly, the centres B, C of the first seat 521 and the second seat 522 are angularly spaced from each other by an angle substantially comprised, between 14° and 25°, preferably by 20°.

Advantageously, the first seat 521 and the second seat 522 are substantially with a circular section (transverse with respect to the rotation axis A) and they are spaced from each other by a distance smaller than the radius of one from among the first and the second seat.

Advantageously, the distance between the centres B, C of the first seat 521 and the second seat 522 is comprised between 1 and 1.3 times the sum of the radii of the first seat 521 and the second seat 522, preferably the distance between the centres B, C of the first seat 521 and the second seat 522 is substantially equal to 1.1 times the sum of the radii of the first seat 521 and the second seat 522 (which have the same radius in the example).

In a possible embodiment not shown, the seats 521 and 522 could also be substantially tangential, conferring a substantially 8-shaped configuration. In still another possible arrangement, the seats 521 and 522 could also be overlapping. In such an arrangement, the distance between the centres B, C of the first and second seats 521, 522 may be less than the radii of the first seat 521 and the second seat 522.

The first seat 521 and the second seat 522 are made of a plate 523, configured as a circular sector whose axis is concentric to the rotation axis A, which is fixed to the control lever 20, so as to integrally rotate therewith around the rotation axis A.

The first seat 521 and the second seat 522 are, for example, substantially cylindrical and provide two through holes through the plate 523.

However, the seats 521 and 522 may be configured otherwise, for example substantially semi-spherical or blind cylindrical or any other technically equivalent configuration.

Furthermore, the deadbolt 51 may be otherwise shaped with respect to the spherical shape and the seat may have a respective complementary shape.

The plate 523 is practically splined on the rotation pin 22 and it is adjustably fixed to the control lever 20 through a threaded Hastening member 524 Such as bolt and a stud.

In practice, when the control lever 20 is rotated with respect to the rotation axis A the first seat 521 and the second seat 522 are selectively superimposed to the cylindrical seat 511, thus allowing the sphere 510 to pass from the retracted position to the extracted position, pushed by the helical spring 512, and thus engage one of the seats 521,522 to simultaneously lock the control lever 20 in the first position or in the second position.

The first seat 521 and the second seat 522 are arranged at a recess of the plate 523, which surrounds and delimits the seats on the perimeter.

In practice, the top part of the cup body which defines the cylindrical seat 511 is adapted to be inserted with clearance into the recess and slide there within during the rotation of the control lever 20.

Such recess extends along the aligning arc of the seats 521 and 523 on the opposite side with respect to the second seat 522, so as to define a pad 525 adapted to allow a third position to the control lever 20, in which the deadbolt 51 is superimposed to said pad 525.

In such third position the control lever 20, suitably positioning the levers which constitute the linkage 30, allows interrupting the delivery of the injection pump 40 so that the engine is switched off.

In the pad 525, for example, there could be arranged a third seat entirely analogous to the first and the second seat, respectively 521 and 522, for example aligned thereto along the same imaginary circumference, equally spaced and arranged so that the first seat 521 is interposed between the second 522 and the third seat.

Thus, the control lever 20 would also be temporarily locked in the third position.

The control lever 20 in the illustrated figures comprises two gripping portions 201 arranged substantially diametrically opposite to the rotation axis A thereof, so as to be gripped manually.

However, the control lever 20 may comprise only one gripping portion 201.

Alternatively or additionally to the gripping portion/s 201, the control lever 20 may further comprise actuation portions 202, also substantially arranged diametrically opposite to the rotation axis A of the control lever 20, which are for example provided with sleeves or analogous systems for fixing the proximal ends to the member controlled by the cables or rigid control rods, such as bowden cables or control rods, whose free end distal from the controlled member is arranged in a position accessible by an operator.

While one example of a detent element is illustrated herein (described above as the combination of the deadbolt 51, the elastic member 512 and the sphere 510), the detent element can take on a wide variety of structural arrangements and components, so long as the desired functioning described above and herein can be achieved. For example, the detent element may simply comprise a protuberant structure that is integrally formed, or subsequently attached, to the selected one of the support element 11 or the control lever 20 (or another component associated therewith). In other arrangements, the detent element can comprise a seat formed directly into the selected one of the support element 11 or the control lever 20 (or another component associated therewith) in which a retractable and extendable element, such as the sphere 510 or resiliently loaded pin element, can be operably nested.

The linkage 30 is configured so as to reduce the oscillation of the controlled member with respect to the oscillation of the control lever 20.

The linkage 30 comprises a first lever 31 whose first end is splined on the projecting portion of the rotation pin 21 from the side of the support element 11 intended to be arranged inside the casing.

The linkage 30 comprises a second lever 32, which has a first end hinged inside the support element 11 with respect to a rotation axis parallel to the rotation axis A of the control lever 20 and eccentric with respect thereto.

The free end of the first lever 31 comprises an extended through slot 310, for example with rectilinear longitudinal axis, within which there is adapted to slide a pin 320, with axis parallel to the rotation axis of the second lever, fixed at the free end of the second lever 32.

The second lever 32 is then connected—through a speed regulator 33, of the type per se known to a man skilled in the art, and not described in detail—to a third lever 34 for controlling the injection pump 40.

In practice, considering a 20° rotation of the control lever, the second lever 32 shall perform an oscillation of approximately 16°.

The device 10 further comprises means for limiting and adjusting the oscillation of the second lever 32, adapted to define and adjust the mechanical end stops therefor at the positions of minimum rotation speed and maximum/optimal rotation speed of the engine.

The limitation and adjustment means comprise a first adjustment screw 61 inserted into a first lug 111 obtained in the support element 11 and a second adjustment screw inserted into a second lug 112 obtained in the support element 11, for example in a position outside the casing.

On the rotation pin of the second lever 32, for example on a portion thereof projecting outside the support element 11 from the side intended to be arranged outside the casing, there is splined a portion rotatably integral with the second lever 32 which extends in the area comprised between the two lugs 111,112, so as to selectively abut, during the oscillation with respect to the rotation axis A of the second lever 32, from one side against the first adjustment screw 61 and on the side against the second adjustment screw 62, respectively when the control lever 20 is in the first position or in the second position.

The linkage 30 then comprises elastic means adapted to define—for each lever 31, 32, 33—stable equilibrium positions countering the rotary actuation thereof and/or for returning to the stable equilibrium position following the stresses imposed by the rotation of the control lever 20.

Lastly, the linkage 30 comprises a fourth lever 35 whose end is oscillating associated to the support element 11, with respect to an oscillation axis parallel to the rotation axis A of the control lever 20 and eccentric with respect thereto, and whose free end is moveable between a position of no contact with the third lever 34, when the control lever 20 is in the first and in the second position, and a position of contact with the third lever 34, when the control lever 20 is in the third position for stopping the engine.

In practice, the third lever 35 is adapted to interfere with the third lever 34 during the rotation, of the control lever 20 between the first position and the third position so as to move the third lever so that it interrupts the fuel delivery of the injection pump 40.

In the light of the description above, the device 10 operates as follows.

Upon adjusting the maximum/optimal and minimum positions and fixing, by simply rotatably actuating the control lever 20 from the third position, in which the engine is off, the same control level can be positioned at the first position, wherein it is locked for the insertion of the sphere 510 in the first seat 521, should one intend to actuate the engine at the allowed minimum rotation speed, or the same can be actuated at the second position, wherein it is locked by inserting the sphere 510 into the second seat 522, should one intend to actuate the engine at the allowed maximum/optimal rotation speed.

The invention thus conceived can be subjected to numerous modifications and variants all falling within the scope of the invention; for example there can be obtained one or more additional seats for the deadbolt, so as to allow a plurality of second positions in which the rotation speed of the engine is different from the minimum, the sole required limitation being that the second seat proximal to the first seat be adjacent to the latter and, for example, all the second seats be contiguous to each other as meant above.

Furthermore, all details can be replaced by other technically equivalent elements.

In practice, the materials used, as well as contingent shapes and sizes, may vary according to the requirements without departing from the scope of protection of the claims that follow.

The invention claimed is:

1. A device for controlling rotational speed of an internal combustion engine, the device comprising:

a control lever movably coupled to a support element;

a detent element associated with one of the control lever or the support element;

a first seat and a second seat associated with the other one of the control lever or the support element;

the control lever actuatable between: a first position in which the detent element engages the first seat and the internal combustion engine operates at a first rotational speed: and a second position in which the detent element engages the second seat and the internal combustion engine operates at a second rotational speed;

wherein when the control lever is at any position between the first and second positions, a biasing force forces the detent element into engagement with either the first seat or the second seat to cause the control lever to automatically assume either the first or second position respectively;

a wall separating the first seat and the second seat, at least one of the wall or the detent element comprising a convex surface, the biasing force forcing the convex surface of the wall or the detent element into contact with a surface of the other one of the wall or the detent element when the control lever is at any position between the first and second positions to cause the control lever to automatically assume either the first or second position respectively.

2. The device according to claim 1 wherein the first rotational speed corresponds to a minimum engine speed and the second rotational speed corresponds to a maximum engine speed.

3. The device according to claim 1 further comprising an elastic member, the elastic member generating the biasing force.

4. The device according to claim 3 wherein the elastic member imparts the biasing force on the detent element.

5. The device according to claim 3 wherein the detent element comprises a cylindrical seat, the elastic member positioned within the cylindrical seat.

6. The device according to claim 1 wherein the detent element comprises a sphere.

7. The device according to claim 1 wherein the wall comprises a narrowed waist section located along an imaginary circumference on which centres of the first and second seats are located.

8. The device according to claim 1 further comprising a plate fixed to the control lever, the plate comprising either the detent element or the first and second seats.

9. The device according to claim 1 wherein each of the first and second seats has a chamfered edge.

10. An internal combustion engine comprising a casing and a device according to claim 1.

11. A device for controlling rotational speed of an internal combustion engine, the device comprising:

a control lever movably coupled to a support element;

a detent element associated with one of the control lever or the support element;

a first seat and a second seat associated with the other one of the control lever or the support element;

the control lever actuatable between: a first position in which the detent element engages the first seat and the internal combustion engine operates at a first rotational speed: and a second position in which the detent element engages the second seat and the internal combustion engine operates at a second rotational speed;

wherein when the control lever is at any position between the first and second positions, a biasing force forces the detent element into engagement with either the first seat or the second seat to cause the control lever to automatically assume either the first or second position respectively;

wherein the control lever is pivotably coupled to the support element so as to be pivotable about a rotation axis, the first position being a first angular position and the second position being a second angular position;

wherein when the control lever is at any angular position between the first and second angular positions, the biasing force forces the detent element into engagement with either the first seat or the second seat to cause the control lever to automatically assume either the first or second angular position respectively; and wherein centres of the first and second seats are located along an imaginary circumference formed about the rotation axis.

12. The device according to claim 11 wherein the biasing force has a direction that is substantially parallel to the rotation axis.

13. The device according to claim 11, wherein said detent element is alterable between an extracted position and a retracted position.

14. The device according to claim 11 wherein the centres of the first and second seats are separated by a preset angle along the imaginary circumference formed about the rotation axis.

15. The device according to claim 14 wherein the preset angle is comprised between 14° and 25°.

16. The device according to claim 15 wherein the preset angle is about 20°.

17. The device according to claim 11 further comprising an elastic member, the elastic member generating the biasing force.

18. The device according to claim 11 further comprising a plate fixed to the control lever, the plate comprising either the detent element or the first and second seats.

19. The device according to claim 11 wherein each of the first and second seats has chamfered edge.

20. A method of controlling rotational speed of an internal combustion engine, the method comprising:

a) applying an actuation force to a control lever to move the control lever, relative to a support element, into an intermediate position between a first position in which the internal combustion engine operates at a first rotational speed and a second position in which the internal combustion engine operates at a second rotational speed;

b) upon cessation of the actuation force, the control lever automatically assuming either the first position or the second position in response to a biasing force;

wherein one of the control lever or the support element has a detent element associated therewith;

wherein the other one of the control lever or the support element has a first seat and a second seat associated therewith;

wherein in the first position, the detent element engages the first seat;

wherein in the second position, the detent element engages the second seat;

wherein the biasing force forces the detent element into engagement with either the first seat or the second seat when the control lever is in the intermediate position and the actuation force is ceased, thereby causing the control lever to automatically assume either the first or second position respectively;

a wall separating the first seat and the second seat; and wherein when the control lever is in the intermediate position, the biasing force forces the wall and the detent element into contact with one another, thereby pushing the detent element into either the first seat or the second seat.

21. The method according to claim 20 wherein the first rotational speed corresponds to a minimum engine speed and the second rotational speed corresponds to a maximum engine speed.

22. The method according to claim 20 further comprising an elastic member, the elastic member generating the biasing force.

23. The method according to claim 20 wherein the control lever is pivotably coupled to the support element; and wherein step a) further comprises applying the actuation force to the control lever to pivot the control lever into the intermediate position, the intermediate position being an angular position and the first and second positions being angular positions.

24. A method of controlling rotational speed of an internal combustion engine, the method comprising:

a) applying an actuation force to a control lever to move the control lever, relative to a support element, into an intermediate position between a first position in which the internal combustion engine operates at a first rotational speed and a second position in which the internal combustion engine operates at a second rotational speed;

b) upon cessation of the actuation force, the control lever automatically assuming either the first position or the second position in response to a biasing force;

wherein the control lever is pivotably coupled to the support element;

wherein step a) further comprises applying the actuation force to the control lever to pivot the control lever into the intermediate position, the intermediate position being an angular position and the first and second positions being angular positions; and wherein the biasing force has a direction that is parallel to the rotation axis.

25. The method according to claim 24 wherein, for all intermediate positions that exist between the first and second positions for the control lever, the control lever automatically assumes either the first position or the second position upon cessation of the actuation force.

26. The method according to claim 24 wherein the first rotational speed corresponds to a minimum engine speed and the second rotational speed corresponds to a maximum engine speed.

27. The method according to claim 24 further comprising an elastic member, the elastic member generating the biasing force.

28. The method according to claim 24 wherein the control lever is pivotably coupled to the support element; and wherein step a) further comprises applying the actuation force to the control lever to pivot the control lever into the intermediate position, the intermediate position being an angular position and the first and second positions being angular positions.

* * * * *